US005721786A

United States Patent [19]

Carrington

[11] Patent Number: 5,721,786

[45] Date of Patent: Feb. 24, 1998

[54] LOUDSPEAKERS

[76] Inventor: Simon Paul Carrington, Newlands, Littlethorpe Lane, Pipon, North Yorkshire, HG4 1UB, United Kingdom

[21] Appl. No.: 986,539

[22] Filed: Dec. 7, 1992

Related U.S. Application Data

[63] Continuation-in-part of PCT/GB91/00925, Jun. 7, 1991.

[30] Foreign Application Priority Data

Jun. 8, 1990 [GB] United Kingdom ..... 9012818

[51] Int. Cl.[6] ..... H04R 25/00

[52] U.S. Cl. ..... 381/202; 381/204; 181/157

[58] Field of Search ..... 381/159, 202, 381/203; 181/148, 156, 157, 144, 163, 155, 199

[56] References Cited

U.S. PATENT DOCUMENTS

| | | | |
|---|---|---|---|
| 2,704,185 | 3/1955 | Tavares | 181/148 |
| 4,198,550 | 4/1980 | Matsuda et al. | 381/203 |
| 4,259,550 | 3/1981 | Nakamatsu | 179/115 |
| 4,517,416 | 5/1985 | Goossens | 381/202 |
| 4,618,025 | 10/1986 | Sherman . | |
| 4,764,968 | 8/1988 | Kreitmeier | 381/204 |
| 4,905,788 | 3/1990 | Lanternier | 181/144 |
| 5,009,280 | 4/1991 | Yokoyama | 381/159 |
| 5,231,672 | 7/1993 | Tsao | 381/203 |

FOREIGN PATENT DOCUMENTS

| | | | |
|---|---|---|---|
| 542761 | 5/1985 | Australia . | |
| 5037 | 10/1979 | European Pat. Off. . | |
| 193886 | 9/1986 | European Pat. Off. . | |
| 0125190 | 10/1981 | Japan | 381/159 |
| 0222700 | 12/1983 | Japan | 381/203 |
| 0024399 | 2/1986 | Japan | 381/203 |
| 0241498 | 10/1987 | Japan | 381/202 |
| 0195797 | 8/1990 | Japan | 381/159 |
| 2037123 | 7/1980 | United Kingdom | 381/203 |
| 8901728 | 2/1989 | WIPO . | |

*Primary Examiner*—Huyen D. Le

*Attorney, Agent, or Firm*—Evenson, McKeown, Edwards & Lenahan, P.L.L.C.

[57] ABSTRACT

An improved loudspeaker comprises an oscillator fitted to an enclosure and able to oscillate to create sound waves. The oscillator, which includes a diaphragm, may be driven in response to an electromagnetic force or passively in response to pressures in the enclosure. The oscillator includes a convoluted tubular chamber which is preferably coiled in a helix about the center of the oscillator. The chamber may be open to the interior of the enclosure and to the exterior of the enclosure. The oscillator should provide a surface area in contact with air in excess to that provided by the diaphragm alone. In a preferred embodiment the baffle forms a framework between two diaphragm membranes,one of which membranes is open centrally to allow access to the center of the baffle and thus to the chamber.

28 Claims, 7 Drawing Sheets

LOUDSPEAKERS

CROSS-REFERENCE TO RELATED APPLICATIONS

This application is a continuation-in-part of copending application No. PCT/GB91/00925, filed Jun. 7, 1991.

BACKGROUND OF THE INVENTION

The present invention relates to improvements in loudspeakers.

In a known high-fidelity system a loudspeaker comprises a cabinet including at least one diaphragm which is usually conical and which is moved in response to the changes in magnetism produced by electrical current from the amplifier passing through a coil. Movement of the diaphragm creates waves in the air mass within the cabinet or in front of the cabinet which we receive as sound. Simultaneous pressure fluctuations are experienced within the cabinet. Traditionally the mid frequency range sounds are most efficiently transmitted. Much has been done to attempt to improve the high and low frequency emissions. Thus many cabinets now additionally comprise tweeter units, bass reflex openings, and a few have passive diaphragms. However it is still only possible to receive a big sound from a large and powerful speaker. The intrusive volume of the mid range frequencies can also be adjusted using a crossover unit to separate the high and low frequencies.

OBJECT OF THE INVENTION

It is the object of the invention to improve the efficiency of existing speakers and to seek to improve the response time of the loudspeaker.

STATEMENT OF INVENTION

According to the present invention there is provided a loudspeaker comprising an enclosure, having an aperture and an oscillator resiliently mounted to oscillate in the aperture, wherein the oscillator comprises a diaphragm, and a convoluted, tubular chamber.

The diaphragm is able to oscillate transversely of the enclosure wall in which it is mounted during resonance. Sound waves are produced during oscillation whether the oscillation is provided by electromechanical drive means or passively as a result of pressure differences across the diaphragm.

In one arrangement the oscillator comprises two diaphragms separated and supported by a framework which acts as a baffle and defines the conduit. Where the conduit is open the oscillator may be designed so that access to one end of the conduit is inside the enclosure and access to the other end of the conduit is outside of the enclosure. This allows an equalisation of air pressure in and out of the enclosure. Preferably the tubular chamber is coiled, for example as a helix, or it may be defined by a series of interconnected perforated concentric circles. Helix (and helical used later) is not used in this specification in the strict mathematical sense and includes, for example, a spiral in a conical configuration and a coil in which the tubular axis is in one plane.

In one embodiment the oscillator is manufactured as an integral unit. In such an embodiment, in which the diaphragms are rigid, one of the diaphragms may allow access to the middle of the coil or to the central circle. The same membrane is resiliently attached to the enclosure. In this way the conduit forms the only air passage across the oscillator. Alternatively the coiled tubular chamber may be closed at one or both ends.

BRIEF DESCRIPTION OF THE DRAWINGS

The invention will now be described, by way of example, with reference to the accompanying drawings in which.

SPECIFIC DESCRIPTION

Figure 1:
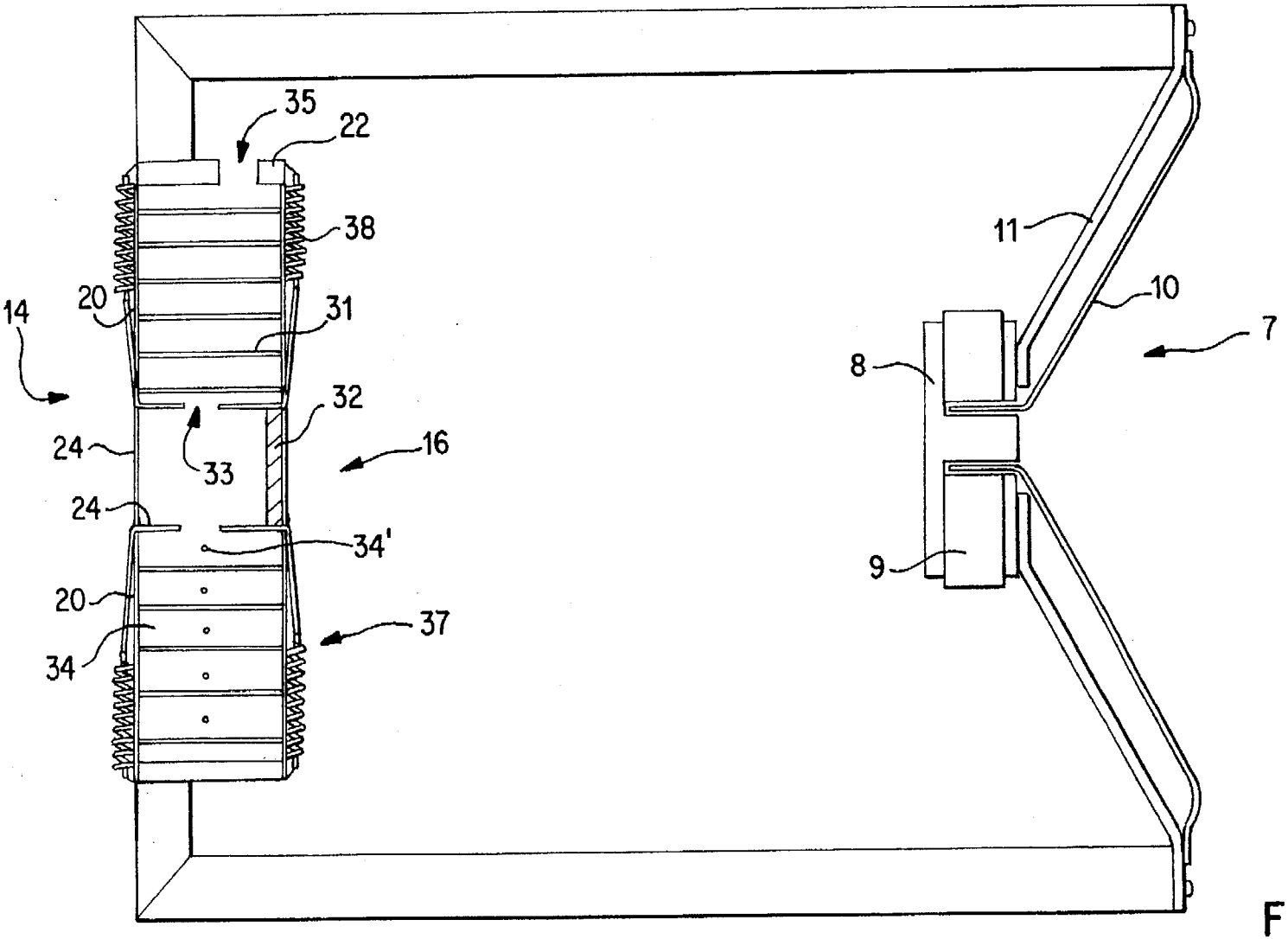
FIG. 1 is a longitudinal cross section of a loudspeaker according to the present invention.

The high-fidelity loudspeaker illustrated in FIG. 1 comprises a traditional speaker unit 9 including an electromagnetically driven diaphragm 10 which creates sound waves in front of the speaker as a result of variations in electrical current from an amplifier (not shown). The frame 8 of the unit is mounted by brackets 11 to a cabinet or enclosure 12 in a first aperture 7 which in this case amounts to the whole width of the cabinet 12.

The cabinet 12 has a second aperture 14 which will normally be in a different face of the cabinet from the driven diaphragm (first diaphragm) 10 and preferably in the opposite face. An oscillator 16 or passive diaphragm is mounted by brackets (not shown) completely to fill the aperture 14. In this case the aperture and oscillator are circular in section but although preferred, it is not necessary that this should be the case and other configurations are possible.

Figure 2:
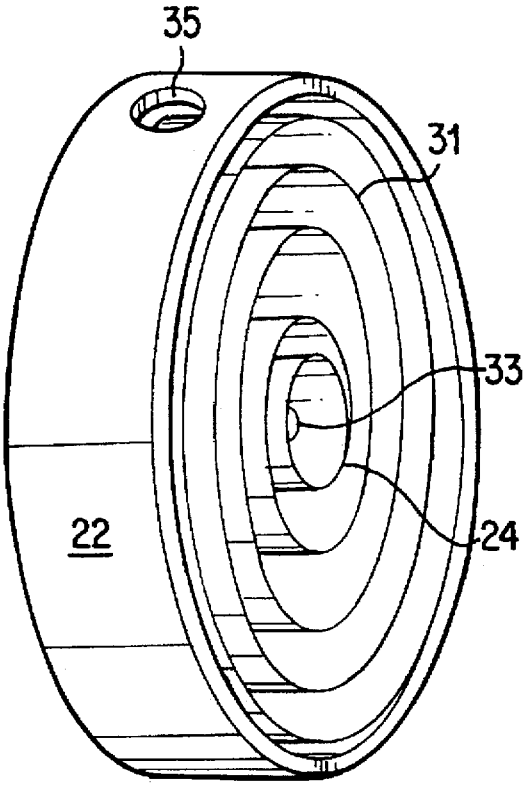
FIG. 2 is a perspective view of the framework of the loudspeaker of FIG. 1.

The oscillator 16 of FIG. 1 and 2 comprises in each case a framework of inner and outer members 24,22 between which is disposed a helical baffle 31 attached at one end to one member 22 and at the other end to the other member 24. The inner and outer members and the baffle 31 are concentric, aligned longitudinally and of substantially the same axial length. The baffle 31 should be made of material which in itself is rigid and lightweight such as Melanex™. The material of the baffle is preferably damped with a substance such as polystyrene by coating both sides of the material. When formed, the baffle 31 is flexible to allow both axial and rotary movement of the inner member 24 relative to the outer member 22.

Where the members 22,24 are circular a suitable ratio of diameters of the inner and outer tubes is of the order of one to five. The tubes 22 and 24 may for example be made of cardboard or plastics material.

The preferred arrangement shown in the drawings illustrates a double diaphragm, which should be as lightweight as possible. In this case two diaphragm membranes 20 are supported spaced from one another stretched between the respective end faces of outer 22 and inner 24 concentric cylindrical tubes. The material of the membranes 20 must be elastic and resilient and preferably non-pervious to air. A resilient rubber-type material may be suitable or a hollow rubber material or Lycra™. The diaphragm membranes 20 may consist of a single piece of tubular fabric which is passed through the inner tube, is stretched outwards laterally and is fastened to the outer tube 22 to produce a double-sided drum. The membranes are coated with an airproof rubber solution to make them airtight.

It is necessary that the life of the oscillator is many years and therefore the fabric of the diaphragm needs to be not only elastic but of a fabric whose elasticity is durable. If there is too much elasticity in the fabric the mechanical energy from the oscillator will not reach the outer tube and so efficiency would be lost. Conversely if a fabric with insufficient stretch is used it will work well at low volume but will knock at full extension eventually distorting the sound and fabric alike. At moderate use at reasonable volumes such a fabric would only last a few hours.

The combination of the framework and the stretched elastic membranes provides a drum which has the qualities of a high tensile fabric and those of an elasticated fabric.

In this embodiment direct access from the inside to the outside of the cabinet through the inner member is blocked by a wall 32 across the inner end of the inner member 24. The framework defines a coiled tubular chamber in which air is vibrated and via which air pressure is equalised across the oscillator from the inside to the outside of the cabinet via porting in the outer member, via a coiled tubular passage 34 formed between the turns of the helical baffle 31 and having a tubular axis 34'; and via porting 33 in the inner member. The number of individual holes 33,35 which create the porting in the respective members is thought not to be important but the total cross-sectional area of the holes in the respective members might be. It is presently thought that the best results will be achieved by making the total cross sectional area of ports 33 in the inner member equal to that of ports 35 in the outer member. However it may be possible to achieve particular effects by making the respective total cross sectional areas different.

It may be preferred to incorporate more than one coiled passage 34 into the drum. In this case a separate porting will be required in each of the inner and outer members 24,22 for each of the passages through which air is required to flow. The presently preferred arrangement has the turns of the baffle at a distance apart in the range ¼ to ½ inch. The exact distance may not be critical but the turns must be sufficiently close to support diaphragm membranes 20.

In operation as the inner tube is moved axially outwards the tube 22 twists round. This pivotal movement of the inner ring releases some of the tension in the diaphragm which is then taken up by the axial movement. This arrangement increases the durability of the membrane fabric.

The helical baffle 31 may be of resilient material, but it is preferred to keep the baffle light and to provide resilience separately. In the FIG. 1 embodiment a number of resilient chords 37 are fixed tangentially to the inner member 24 and perpendicularly to the outer member 22. As illustrated these include four tension springs 38 arranged evenly around the inner member. Between the inner member 24 and the outer member 22 directly in line with each of the resilient chords there is fixed a non-resilient tensioning chord 39. The action of the non-resilient chords 39 is to allow the inner member 24 to turn about its axis relative to the outer member 22 and to restore the framework as the inner member 24 returns to its natural position. The chords 37,39 are preferably arranged outside the membranes and in parallel pairs with one set lying on each of the membranes 20. The combination of chords and tension springs acts in a similar way to the spider in a driven oscillator.

Even when the baffle 31 is not resilient it functions as a stiffener and spacer to keep the two membranes 20 parallel to one another. This prevents the membranes moving more than necessary and thus minimises interference noise as the membranes do not belly. In principle this embodiment consists of a coiled column of air contained in a drum and able to oscillate along the drum axis. When the drum is not closed, the helical passage is the only route for air pressure equalisation between the loudspeaker cabinet and the exterior of the cabinet. The column of air in the passage 34, which may be some 10 feet long, operates as a pneumatic spring and air brake. As the pressure in the cabinet increases air is forced into the drum. The helical passage delays the flow of air through the drum by extending and contracting the length of the passage as the drum oscillates which creates viscosity, drag, and consequent delay in flow. With a reduction in pressure in the cabinet air will be drawn to the cabinet from the drum making the air flow in the opposite direction. The action of the unit as a pneumatic spring increases the efficiency of the drive unit and improves the attack of the speaker because there is more surface contact with the air and thus greater surface tension.

The structure and membranes of the oscillator of FIGS. 1 and 2 could be made as an integral unit out of plastics material. In this case the resilient chords can probably be dispensed with.

The oscillator 16 works very effectively backing to the driven diaphragm 10 but it can be attached advantageously anywhere inside or outside the speaker cabinet. The loudspeaker cabinet can even be reduced to a short tube with the driven diaphragm 10 at one end and the oscillator 16 at the other end. Even in such a confined space the speaker will give a more than adequate bass response. In principle a given loudspeaker will function more efficiently in less than half the normal volume of air if the cabinet is fitted with such an oscillator. It is thought that the ultimate sound would be produced from a multi-sided cabinet with a driven diaphragm in one side and an oscillator in every other side. For example if a twenty four sided cabinet were built in this way one could approach a pulsating sphere of sound.

It is currently thought that the oscillator 16 works as follows: As the driven diaphragm 10 is pulsed outwardly of the cabinet a pressure drop is experienced in the air volume in the cabinet. This causes a slight inward movement of the inner tube 24 which movement is quickly superceded by its return reciprocation assisted by the resilience of the diaphragms and an influx of air being drawn rapidly through the moving tube 24. The speed of reaction of the tube 24 creates a secondary vacuum because both the speaker driven diaphragm 10 and the bass port diaphragm 17 reach the apex of their outer strokes simultaneously. This creates nearly double the amount of increased atmospheric pressure outside the cabinet. Conversely internal pressure and external vacuum occur virtually simultaneously. This opposite movement of the two diaphragms with the associated opposed thrusts assists in the stabilisation of the cabinet.

In the past it has been necessary to tune a speaker cabinet. However because the oscillator 16 varies the volume of air within the cabinet, adjusting it exactly to the sound output from the loudspeaker, exact tuning will no longer be necessary.

The effect of using an oscillator 16 such as that described above in a loudspeaker cabinet is an improved and enhanced bass and mid range response. The efficiency of the speaker is so improved that the sound quality is equivalent to a traditional speaker having double the magnet and diaphragm size and double the cabinet size. This is because the oscillating secondary diaphragm acts both to amplify and modulate all frequencies of sound emission from the driven diaphragm.

It will be appreciated that in addition to providing a speaker containing an oscillator 16 it will be possible to modify existing speakers to fit an oscillator. Where the driven diaphragm 10 is in the front panel of the cabinet, the reciprocator should preferably be fitted in the back panel.

Figure 4:
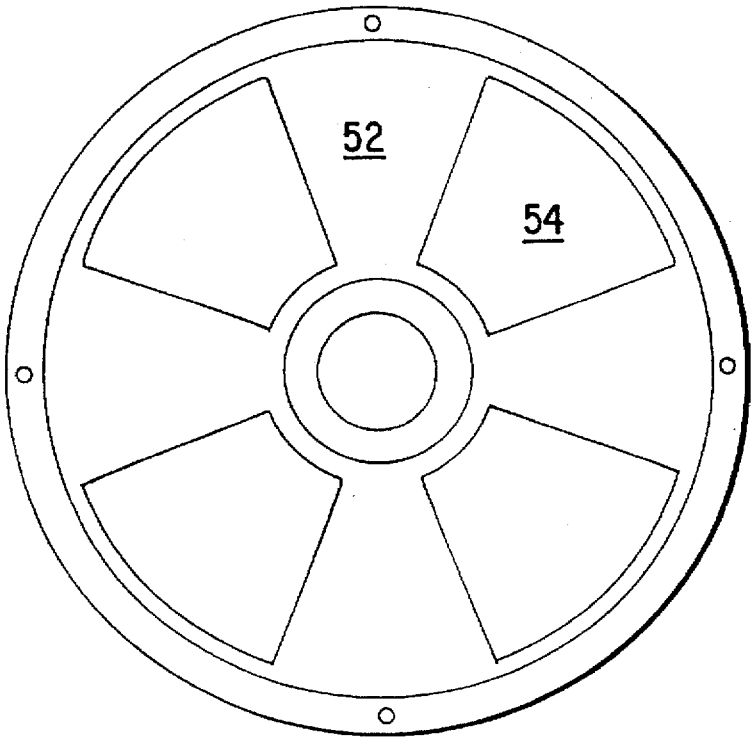
FIG. 4 is a rear view of the frame of the drive unit of the loudspeaker of FIG. 3.
Figure 3:
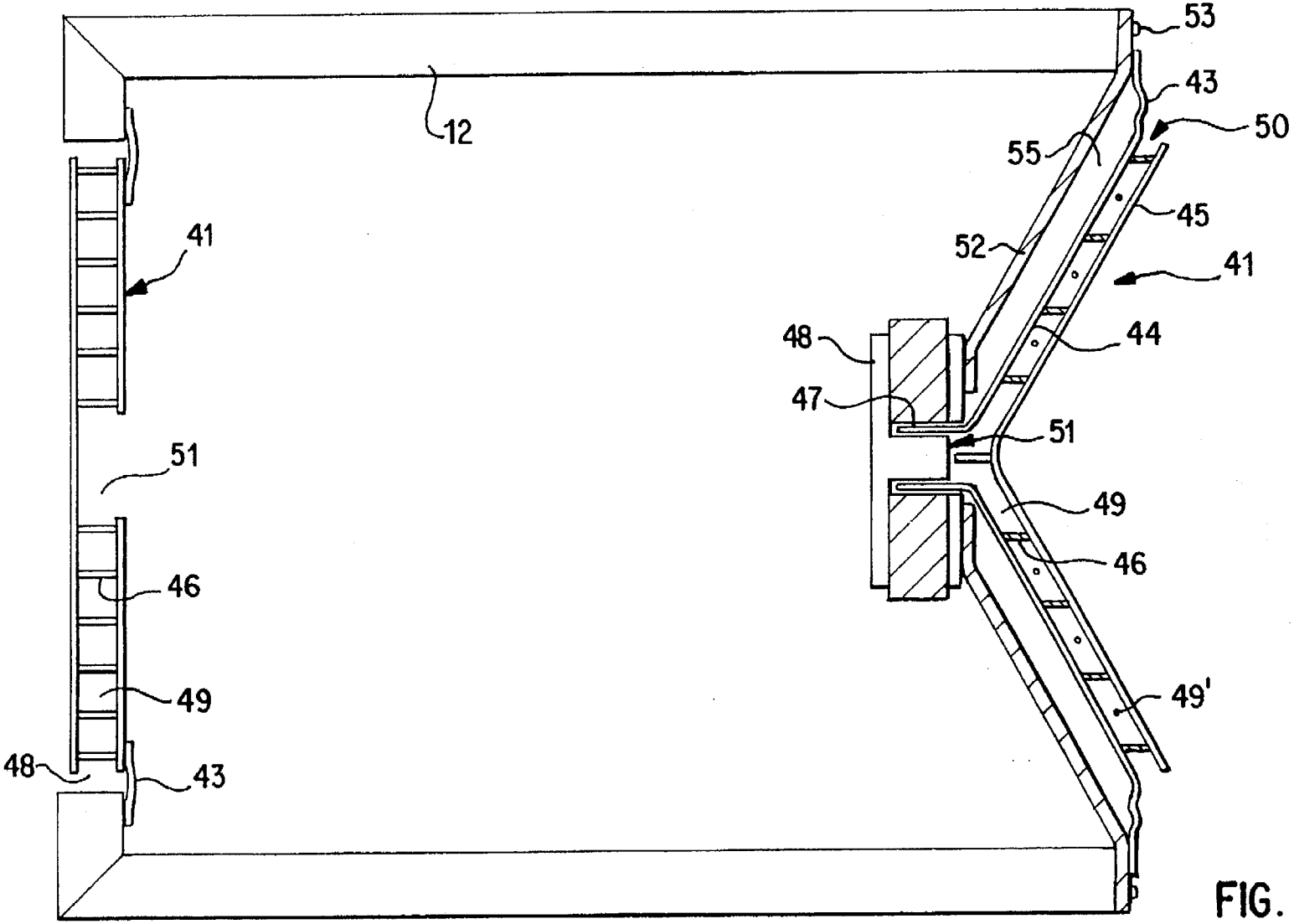
FIG. 3 is a longitudinal cross-section of a second loudspeaker in accordance with the present invention.

In the embodiment of FIGS. 3 and 4, instead of using a fixed outer member 22 and an oscillating inner member the oscillator 41 is a rigid structure which is resiliently mounted to the cabinet via a mounting 43 including a spider and rubber seal. The oscillator oscillates as a whole with respect to the cabinet against the resilient bias of the mounting 43. In this embodiment the driven unit 10 is also provided with an oscillator 41 incorporating a tubular air chamber.

The driven oscillator 41 comprises two parallel diaphragms 44,45 vacuum formed integrally with and separated by a framework which forms a baffle 46 in the shape of a helix. The oscillator includes a sleeve 47 which fits over the electrical windings (not shown) and the magnet 48. The two diaphragms 44,45 are conical and the inner diaphragm 44 is ported at the centre so that the sleeve 47 is open. The inner diaphragm 44 is resiliently mounted to the cabinet 12 via the mounting 43. The helical baffle 46 forms a coiled tubular chamber 49 (having a tubular axis 49') the outer end 50 of which opens outside the cabinet at the rim between the two diaphragms, and the inner end of which opens into a chamber 51 adjacent the sleeve 47 and thus has access to the inside of the cabinet 12 via the sleeve. The tubular chamber has a coil centre concentric with the centre of the diaphragm.

The magnet 48 is supported on a frame 52 which is bolted to the enclosure via bolts 53. The frame has four apertures 54 through which air can pass from the cabinet 12 into a space 55 between the frame and the inner diaphragm. Air has access from this space to the chamber 51 via the electrical windings. In an alternative embodiment the inner diaphragm can be closed across the centre with the outer diaphragm having a central opening and being attached to the cabinet via the mounting 43. This will leave an opening from the space 55 to the outer end of the helix and from the inner end of the helix to the exterior of the enclosure via the central opening in the outer diaphragm.

During oscillation surface contact with air includes the exterior area of the outer diaphragm, the inner area of the outer diaphragm, the outer area of the inner diaphragm and most of both sides of the baffle. Moreover air is creating surface tension with the sides of the conduit. The surface tension so created is now at least 220–260% greater than it would be with a similar sized simple diaphragm of the type usually used.

If the total surface area of the diaphragm is 2D the total surface area of two diaphragms is 4D added to which is the area of both sides of the baffle 2B. This represents an increased or excess area of (4D+2B)/2D% over the area of a diaphragm alone.

In one example the surface area 2D=328 $cm^2$ and the baffle is 2.56 cm wide and 1 meter long giving an area 2B of 512 $cm^2$. Thus the excess area is (328+512)/328=256% of the diaphragm surface area. By altering the length of the baffle it is possible to change the excess contact area. Preferably an excess area of at least 150% will be used. A maximum baffle length of 3 meters is thought to be sufficient, in which case the excess area will be 568% for the same size diaphragm.

The passive oscillator on the left hand side of the drawing FIG. 3 is constructed in accordance with the same principles. In this example however it is shown flat rather than conical. The components are the same and they are assembled and operate the same way. There is no sleeve equivalent to 47 as this is not required in a passive oscillator. The chamber 51 is therefore directly open to the interior of the enclosure. In many cases a conical shape is preferred because it is a stronger and more rigid structure for the same weight. The cabinet in FIG. 3 is shown with an oscillator at each end. The driven oscillator shown here could be used without the passive oscillator and vice-versa.

The number of turns of the helical baffle 31 chosen will depend on operating conditions. However it is thought that more turns should be used on a passive oscillator than on a driven oscillator.

The oscillator 41 should be generally rigid with some slight flexibility.

Figure 5:
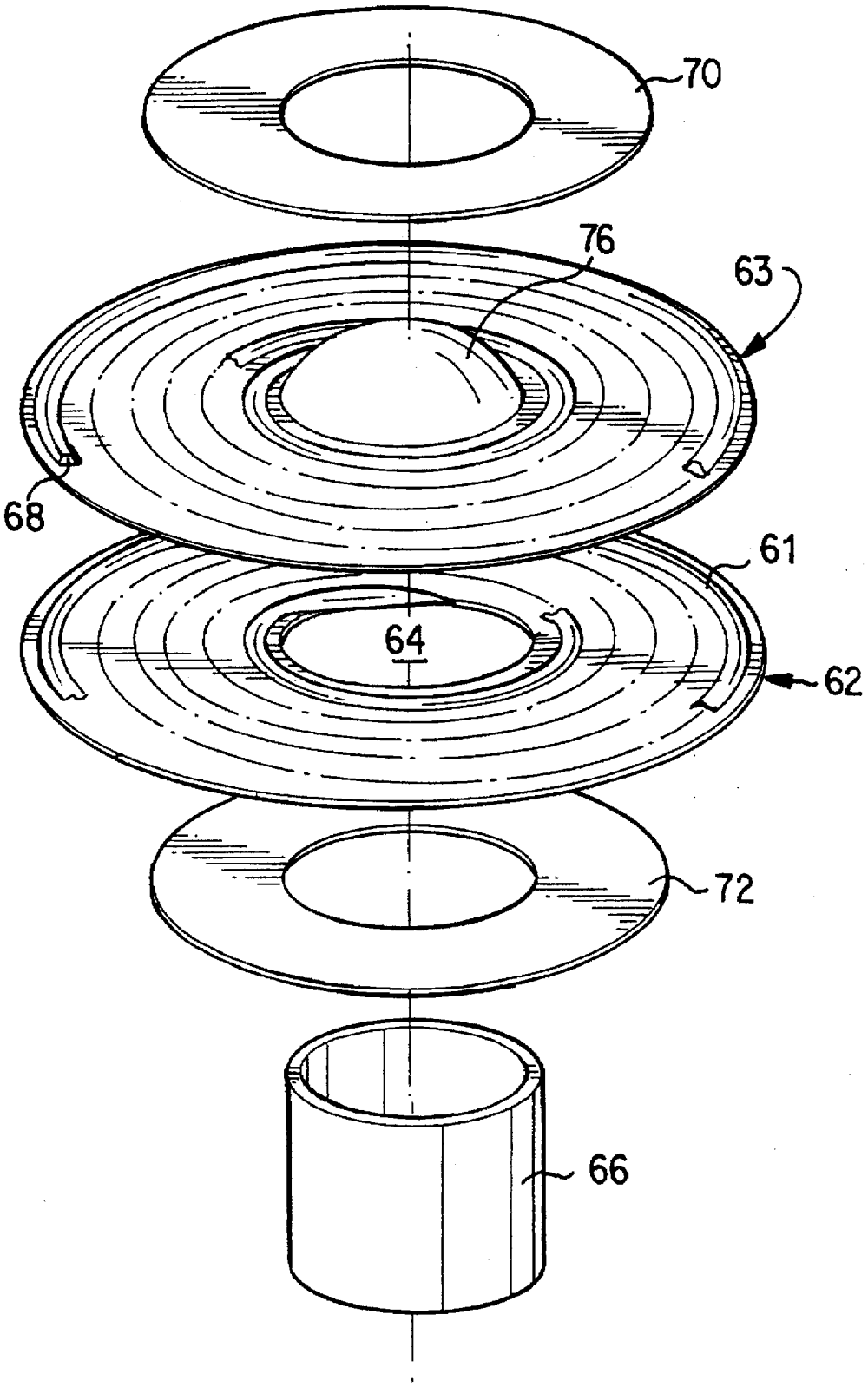
FIG. 5 is an expanded view of a further oscillator for use in a loudspeaker according to the invention.

FIGS. 5 to 8 illustrate variations on a further embodiment in which the oscillator includes a unit comprising a helical tubular chamber 61 formed between two moulded plastics material diaphragms 62,63. These diaphragms 62,63 are either formed together integrally, or formed separately and subsequently fitted together, for example using an adhesive. The chamber may be open at each end, open at one end only, or closed. FIG. 5 illustrates a unit in which the chamber 61 is open at both ends. A central opening 64 is formed in one of the diaphragms 62. This opening 64 communicates with a tube 66 which is fitted to the diaphragm 62. On the other side of the oscillator, the other diaphragm 63 is apertured at 68 at the outer end of the chamber 61 so that the chamber 61 is open to the atmosphere. Thus a through flow of air is possible through the chamber across the oscillator.

As in the case of previously described embodiments, the oscillator is designed to be fitted to oscillate in an aperture in an enclosure (not shown). Usually the tube 66 will be located within the loudspeaker enclosure and the aperture 68 will be outside the enclosure.

The surface area in contact with the air and the quantity of relevant sound waves that can be set up can be increased by the provision of face plates 70,72 which are incorporated on one or on each side of the oscillator. The face plates are attached to the oscillator diaphragm panels. Because the diaphragms are moulded to form the helical chamber, a further helical chamber 73 is created between the oscillator and each of the face plates. This chamber 73, will be open at one end on each side of the oscillator. The face plate attached to the diaphragm 62 will have a central opening to accommodate the tube 66. The face plate 70 attached to the diaphragm 63 in this case has a central opening to accommodate a central bulge 76 in the diaphragm opposite the opening in the diaphragm 62.

Figure 6:
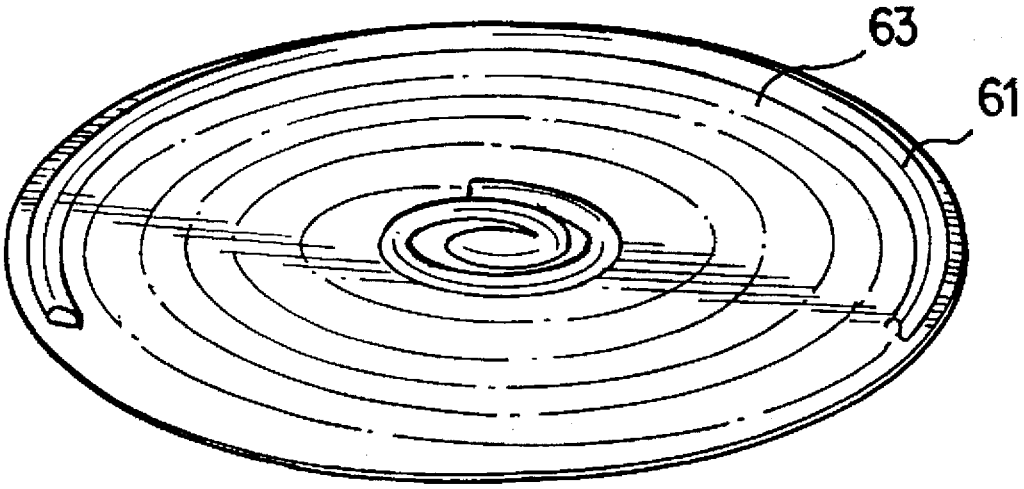
FIG. 6 is a top view of an oscillator diaphragm similar to that of FIG. 5 but with the chamber closed.

FIG. 6 illustrates an oscillator which is formed in a similar way to the oscillator of FIG. 5, but in this case the ends of the helical chamber are closed. Face plates 70,72 can optionally be used with this oscillator but the tube 66 is not required. Because the chamber is dosed it can be filled with a fluid other than air.

Figure 7:
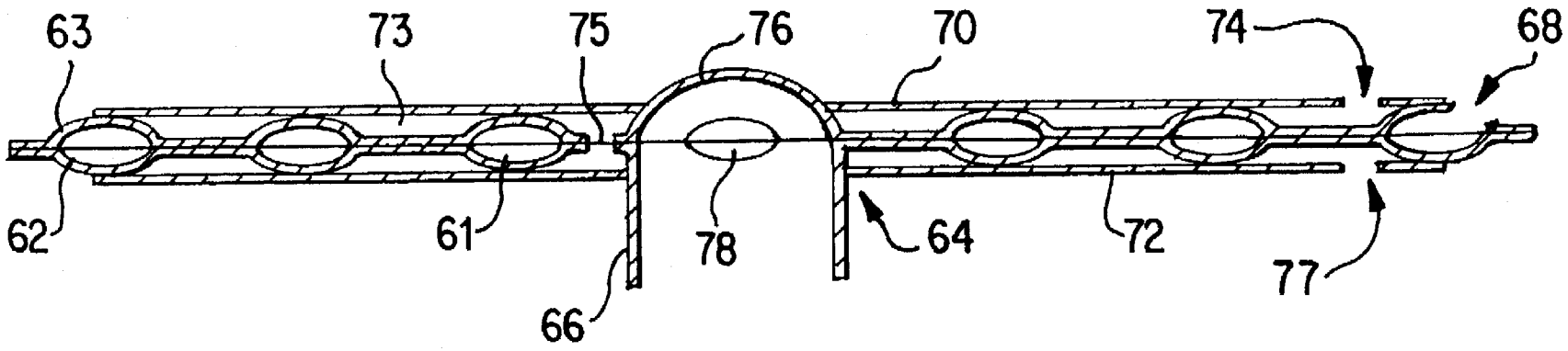
FIG. 7 is a cross section of the oscillator of FIG. 5
Figure 8:
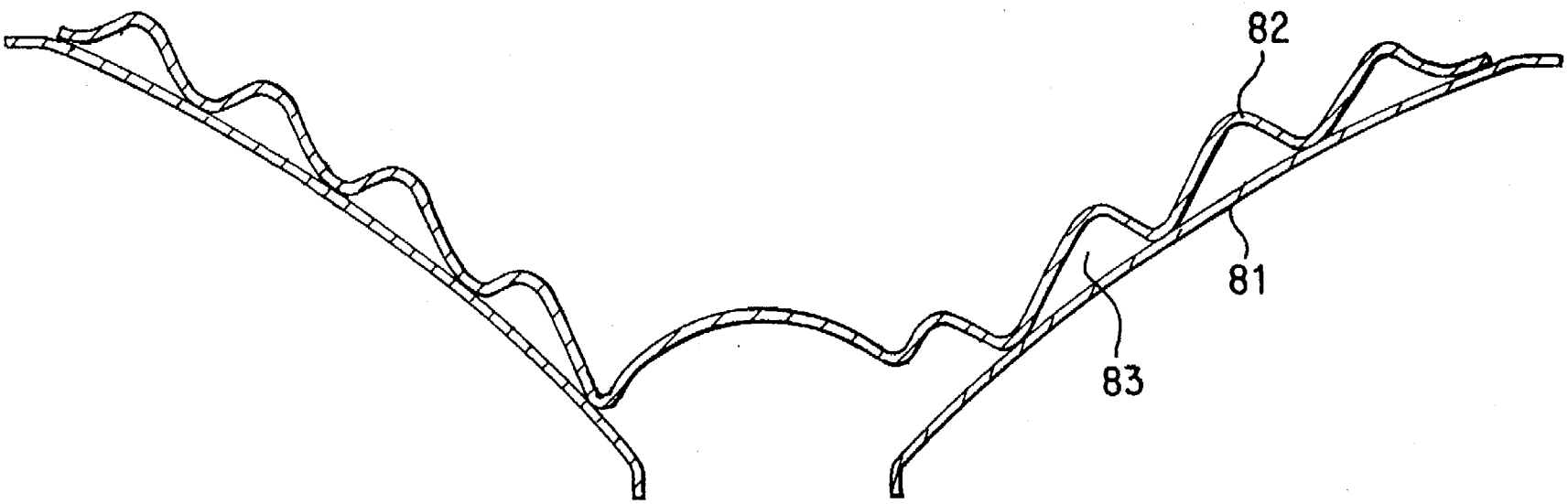
FIG. 8 is a cross section of another suitable oscillator for use in a loudspeaker according to the invention.

FIGS. 7 and 8 illustrate embodiments of oscillators showing different sections for the helical tubular chamber. FIG. 7 is substantially the same as the oscillator in FIG. 5. However in FIG. 7 it is possible to see the vents 74,75,76 allowing a flow of air through the outer helical chambers 73. An air passage is formed from the vent 74 in the outer plate, through the vent 75 in the diaphragms, to the vent 77 in the inner plate. The interior of the enclosure is connected to the chamber via a port 78 which is one end of the helical tubular chamber. The other end of the chamber vents to the atmosphere outside the enclosure via the aperture 68.

FIG. 8 illustrates a further diaphragm moulding which will create a tubular chamber in the oscillator. In this conical oscillator one diaphragm membrane 81 is a flat conical shape. The other diaphragm membrane 82, which is adhesively connected to the diaphragm membrane 81, is formed with a helical coiled groove, which when the diaphragms membranes are joined, forms a helical tubular chamber 83 between the diaphragm membranes. It will be appreciated that the chamber may be formed by using other moulded forms of diaphragms. For example the diaphragm 81 could also be formed with a cooperating helical groove.

All the oscillators in FIGS. 5 to 8 enable the air pressure in the enclosure to interact with the external air pressure.

Although the embodiments here are specifically described in reference to high fidelity loudspeakers, the principle is equally applicable to other applications requiring the delivery of an improved sound, for example a loudspeaker in the form of a hearing aid, or a musical drum.

I claim:

1. A loudspeaker comprising:

an enclosure having an aperture; and an oscillator resiliently mounted to oscillate in the aperture, wherein the oscillator comprises a first helical diaphragm having surfaces, said diaphragm including a continuous coiled tubular chamber having a tubular axis substantially parallel to the surfaces of the diaphragm.

2. A loudspeaker according to claim 1 in which said diaphragm has a centre and the coil of said coiled tube has an axis and wherein the axis of said coil is substantially coaxial with the centre of said diaphragm.

3. A loudspeaker according to claim 1 or 2 in which said enclosure has an inside and an outside and wherein said tubular chamber is in flow communication with said inside of the enclosure.

4. A loudspeaker according to claim 3 wherein said tubular chamber is in flow communication with said outside of the enclosure.

5. A loudspeaker according to claim 1 in which one surface of the diaphragm partially defines said tubular chamber.

6. A loudspeaker according to claim 5 including a second diaphragm mounted substantially parallel to said first diaphragm wherein the tubular chamber is also partially defined by said second diaphragm.

7. A loudspeaker according to claim 6 wherein said second diaphragm is spaced from the first diaphragm, the oscillator including baffle means separating said diaphragms which baffle means defines the shape of the tubular chamber.

8. A loudspeaker according to claim 7 including a framework supporting the said diaphragms, said framework comprising said baffle means and an inner member and an outer member connected to said baffle means, said inner member being able to oscillate relative to said outer member; and the said oscillator including porting to the tubular chamber disposed in the inner and outer members.

9. A loudspeaker according to claim 7 wherein one of said diaphragms is ported to allow flow communication from the enclosure to the tubular chamber, said one diaphragm being mounted to said enclosure.

10. A loudspeaker according to claim 6 wherein the diaphragms are formed, crimped or moulded to create the tubular chamber.

11. A loudspeaker according to claim 10 wherein one of said diaphragms is ported to allow flow communication from the enclosure to the tubular chamber.

12. A loudspeaker according to claim 10 in which the diaphragms each have a surface partially defining the chamber, and a second surface, wherein the oscillator includes a plate fitted to the second surface of one of the diaphragms to define a second coiled chamber.

13. A loudspeaker according to claim 12 wherein the oscillator includes a plate fitted to the second surface of the other diaphragm to create a third coiled chamber.

14. A loudspeaker according to claim 13 wherein the plates and diaphragms are ported to create an air conduit across the oscillator via the second and third coiled chambers.

15. A loudspeaker according to claim 6 wherein the oscillator is conical.

16. A loudspeaker according to claim 1 wherein the said oscillator is electromechanically driven and the loudspeaker enclosure has a second aperture, wherein the loudspeaker includes a second oscillator mounted resiliently to oscillate in said second aperture, the second oscillator including a second diaphragm, and a second coiled tubular chamber.

17. A loudspeaker according to claim 16 wherein the or each chamber defines conduit means for carrying air inwardly or outwardly of the centre, said conduit means i) providing a surface area in contact with the air which is in excess of the surface area of the relative diaphragm, and ii) interconnecting the interior of the enclosure with the exterior.

18. A loudspeaker according to claim 1 wherein the oscillator i) provides a surface area in contact with the air which is in excess of the surface area of the diaphragm.

19. A loudspeaker according to claim 18 wherein the excess surface area of the oscillator over the surface area of the diaphragm is at least 150% of the surface area of one surface of the diaphragm.

20. A loudspeaker according to claim 19 wherein the said excess surface area is between 200% and 300% of the surface area of one surface of the diaphragm.

21. A loudspeaker according to claim 18 in which one surface of the diaphragm partially defines said tubular chamber.

22. A loudspeaker according to claim 18 including a second diaphragm mounted substantially parallel to said first diaphragm wherein the tubular chamber is also partially defined by said second diaphragm.

23. A loudspeaker comprising an enclosure having an aperture, and an oscillator resiliently mounted to oscillate in the aperture, wherein the oscillator comprises a a first helical diaphragm having surfaces and a centre, said diaphragm including a continuous coiled tubular chamber having a tubular axis substantially parallel to the diaphragm and having a coil axis substantially coaxial with the centre of the surfaces of the diaphragm.

24. A loudspeaker according to claim 23 wherein the tubular chamber is closed.

25. A loudspeaker according to claim 23 wherein the tubular chamber is open at one end.

26. A loudspeaker according to claim 23 wherein the tubular chamber is open at both ends.

27. A loudspeaker comprising:

an enclosure having an aperture; and an oscillator resiliently mounted to oscillate in the aperture, wherein the oscillator comprises a helical diaphragm having surfaces, said diaphragm including a single continuous coiled tubular chamber having a coiled tubular axis substantially parallel to the surfaces of the diaphragm.

28. A loudspeaker comprising:

an enclosure having an aperture; and an oscillator resiliently mounted to oscillate in the aperture, wherein the oscillator comprises a helical diaphragm having a first surface facing an interior of the enclosure and a second surface facing an exterior of the enclosure, said diaphragm including a continuous coiled tubular chamber between said first and second surfaces and having a coiled tubular axis substantially parallel to the first and second surfaces of the diaphragm.

* * * * *